US008178813B2

(12) United States Patent
Ren

(10) Patent No.: US 8,178,813 B2
(45) **Date of Patent: *May 15, 2012**

(54) VACUUM SWITCH TUBE

(75) Inventor: Jianchang Ren, Beijing (CN)

(73) Assignee: Beijing Orient Vacuum Electric Co., Ltd., Beijing (CN)

( * ) Notice: Subject to any disclaimer, the term of this patent is extended or adjusted under 35 U.S.C. 154(b) by 243 days.

This patent is subject to a terminal disclaimer.

(21) Appl. No.: 12/698,859

(22) Filed: Feb. 2, 2010

(65) Prior Publication Data

US 2011/0186546 A1 Aug. 4, 2011

(51) Int. Cl.
*H01H 33/66* (2006.01)

(52) U.S. Cl. ..... 218/127; 218/146
(58) Field of Classification Search ..... 218/123–127, 218/142, 146
See application file for complete search history.

(56) References Cited

U.S. PATENT DOCUMENTS

| | | | | |
|---|---|---|---|---|
| 4,021,633 | A * | 5/1977 | Kuwabara et al. | 200/262 |
| 6,211,479 | B1 * | 4/2001 | Ohara et al. | 218/146 |
| 7,131,866 | B2 * | 11/2006 | Zuch | 439/578 |
| 2011/0169593 | A1 * | 7/2011 | Hu et al. | 335/174 |

* cited by examiner

*Primary Examiner* — Truc Nguyen
(74) *Attorney, Agent, or Firm* — J.C. Patents

(57) ABSTRACT

A vacuum switch tube is provided, which includes a first conductive rod and a second conductive rod disposed with a first contact and a second contact respectively. The two contacts are sealed in a vacuum tube body and disposed facing each other. A front end of the first contact is a convex hemisphere. A contact body of the second contact is an annular body matching with the front end of the first contact. The first contact includes a first conductive member and a first magnetic member. The first conductive member and the first magnetic member extend in the same direction and match with each other. The first conductive member and the first magnetic member of the first contact are yin-yang-fish matched in shape, the cross section shape of the first magnetic members is divided by a neutrality line into two unequal regions. The second contact includes a second conductive member and a second magnetic member for forming the contact body of the second contact. The first magnetic member of the first contact and the second magnetic member of the second contact are anti-symmetrically disposed. Therefore, the re-ignition possibility during voltage breaking is reduced, an arc voltage is decreased, and effective arc-extinguishing is realized, thereby satisfying the high voltage breaking requirements.

7 Claims, 2 Drawing Sheets

VACUUM SWITCH TUBE

FIELD OF THE TECHNOLOGY

The present invention relates to a vacuum switch tube, and more particularly to a vacuum switch tube with corresponding contacts disposed in an arc-extinguishing chamber, which belongs to the field of electric technology.

BACKGROUND

A switch device is an essential device in a circuit, which functions to turn on or turn off the circuit. In a process of turning off a switch contact, the arc-extinguishing needs to be performed, such that the contact is enabled to be turned off resolutely and prevent the arc from raising the temperature of the switch and even damaging the switch. As the vacuum switch has small gaps, high voltage-resistant capability, low arc voltages, high current breaking capability, low electrical erosion, and long electrical endurance, the vacuum switch has been widely applied in power circuits.

A core member of a vacuum switch tube is a vacuum arc-extinguishing chamber in a shell. The performance of the contacts inside the vacuum arc-extinguishing chamber directly decides the performance of the vacuum switch tube. Rear ends of the vacuum switch tube are respectively connected to a dynamic conductive rod and a static conductive rod. A motion of turning off the contact is to disconnect the contact mechanically by operating the dynamic conductive rod. When the contact is being turned off, a contact area of the contact becomes increasingly small, till the contact has only one contact point. At the same time, a contact resistance is increased and a regional temperature is raised. Until the contact point is melted, evaporated, and ionized, the metal vapor maintains the discharging in vacuum, so as to generate a vacuum arc and eventually accomplish the electrical disconnect of the contact.

A defect in the prior art is that, the vacuum switch tube usually fails to form a desirable vertical magnetic field for performing arc-extinguishing due to the restriction of a structural shape, such that problems such as electric field concentration, insufficient voltage resistance, and high re-ignition possibility during the high voltage breaking process are difficult to be solved. For a high voltage circuit, only the 36-kilovolt voltage breaking can be realized. For a higher voltage circuit, particularly, 72-kilovolt high voltage circuit, currently, no vacuum switch tube structure is available for satisfying effective arc-extinguishing requirements during the breaking process.

SUMMARY

The present invention is directed to a vacuum switch tube, which is applicable to reduce re-ignition possibility during voltage breaking, decrease an arc voltage, and realize effective arc-extinguishing, thereby satisfying high voltage breaking requirements.

In order to realize the above objectives, the present invention provides a vacuum switch tube, which includes a first conductive rod and a second conductive rod. A first contact is disposed at an end of the first conductive rod. A second contact is disposed at an end of the second conductive rod. The first contact and the second contact are sealed in a vacuum tube body and disposed facing each other. A front end of the first contact is a convex hemisphere. The second contact is an annular body matching with the shape of the convex hemisphere. The first contact includes a first conductive member and a first magnetic member. The first conductive member and the first magnetic member extend in the same direction and match with each other, the cross section shape of the first magnetic members is divided by a neutrality line into two unequal regions. The second contact includes a second conductive member and a second magnetic member. The second conductive member and the second magnetic member are partitioned by a midline of the second contact. The first magnetic member of the first contact and the second conductive member of the second contact are correspondingly disposed. The second magnetic member of the second contact and the first conductive member of the first contact are correspondingly disposed.

In the vacuum switch tube of the present invention, in one aspect, a structure of the first magnetic member of the first contact is designed to enable lines of magnetic force to change from surrounding the circumference of one contact to flow into the other contact, so as to form a vertical magnetic field between the two contacts. In another aspect, the two contacts are configured into a convex hemisphere and an annular body matching and coupling with each other. Thus, a magnetic field distribution in the prior art with uniform lines of magnetic force formed between two parallel planes is changed into a magnetic field distribution with radial lines of magnetic force formed between two spatial surfaces. The rotation of lines of magnetic force is easily formed between the contact surfaces while effectively reducing a magnetic field intensity, and a rotating closed magnetic field loop is generated, so as to increase the high voltage resistant capability of the contact surfaces and enhance the current breaking capability of the vacuum switch contact, such that the vacuum switch tube is applicable to higher voltage circuitry, thereby satisfying the high voltage resistant requirements for a vacuum switch tube in an electric power equipment.

The technical solutions of the present invention are further illustrated below in detail with reference to the accompanying drawings and embodiments.

DETAILED DESCRIPTION

The present invention provides a vacuum switch tube, in which rotating lines of magnetic force are formed between contact surfaces of two vacuum contacts in a vacuum chamber, so as to effectively enhance current breaking and high voltage resistant capabilities of the vacuum switch tube, thereby satisfying a demand for a switch in the high-voltage electric power equipment.

The vacuum switch tube of the present invention includes a first conductive rod and a second conductive rod. A first contact is disposed at an end of the first conductive rod. A second contact is disposed at an end of the second conductive rod. The first contact and the second contact are sealed in a vacuum tube body and disposed facing each other. A front end of the first contact is a convex hemisphere. A contact body of the second contact is an annular body matching with the shape of the front end of the first contact. The first contact includes a first conductive member and a first magnetic member. The first conductive member and the first magnetic member extend in the same direction and match with each other, the cross section shape of the first magnetic members is divided by a neutrality line into two unequal regions. The second contact includes a second conductive member and a second magnetic member for forming the contact body of the second contact. The first magnetic member of the first contact and the second magnetic member of the second contact are anti-symmetrically disposed.

Figure 2:
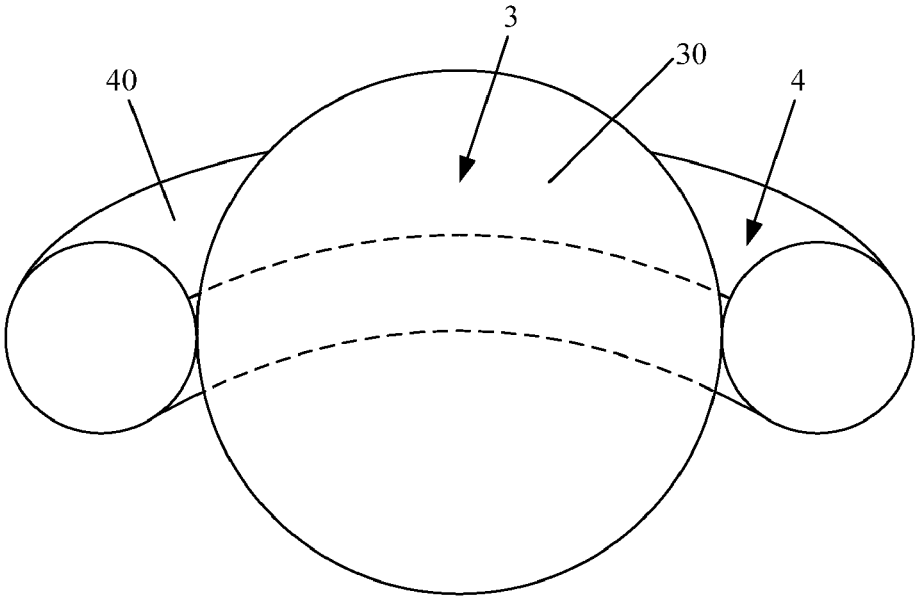
FIG. 2 is a schematic cross-sectional structural view of two contacts of the vacuum switch tube according to the first embodiment of the present invention.

The neutrality line is defined as follows: one region with arbitrary shape has a maximum characteristic length line. The region could be sandwiched between two parallel lines perpendicular to the characteristic length line, and the two parallel lines have a maximum distance and subject to a restriction that they could touch this region. A central line having the same distance depart from the two parallel lines is the neutrality line of this region. As shown in FIG. 2, when the cross section of the first magnetic member is sandwiched between two parallel lines which have the maximum distance, the transverse central line X of the first contact body is the neutrality line of the cross section shape of the first magnetic member.

As known from the above, in one aspect, the present invention correspondingly disposes structures of a convex hemisphere contact and an annular body contact matching with the shape of the convex hemisphere contact in the vacuum switch tube. In another aspect, the shape of the first magnetic member of the first contact may be a unequal shape in which the area of one end is larger than that of another end, that is, the cross section shape of the first magnetic members is divided by a neutrality line into two unequal regions. The technical solutions do not depart from the scope of the present invention, as long as the cross section shape of the first magnetic member of the first contact has the above shape characteristics.

First Embodiment of Vacuum Switch Tube

Figure 1:
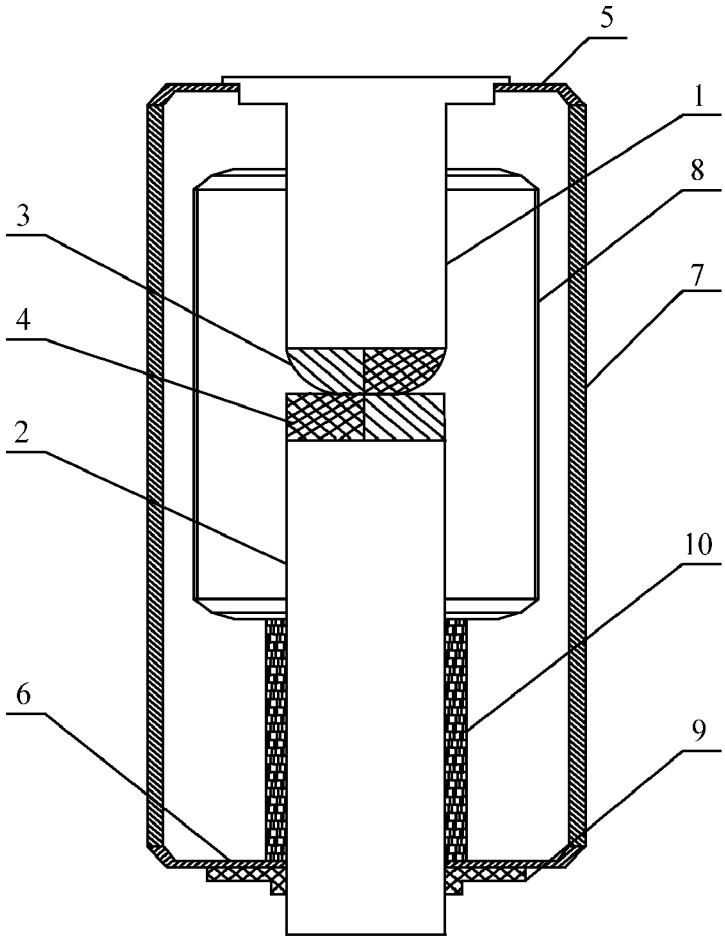
FIG. 1 is a schematic structural view of a vacuum switch tube according to a first embodiment of the present invention.

FIG. 1 is a schematic structural view of a vacuum switch tube according to a first embodiment of the present invention. As shown in FIG. 1, the vacuum switch tube in this embodiment includes a first conductive rod 1 and a second conductive rod 2. A first contact 3 is disposed at a lower end of the first conductive rod 1. A second contact 4 is disposed at an upper end of the second conductive rod 2. The first contact 3 and the second contact 4 are sealed in a vacuum tube body 8, so as to form a vacuum arc-extinguishing chamber. The first conductive rod 1 is fixed in an insulating housing 7 through a first end cover plate 5. The second conductive rod 2 is slidably disposed at a lower end of the insulating housing 7 through a second end cover plate 6. A guide sleeve 9 is disposed outside the second end cover plate 6, and is slidably matched with a portion of the second conductive rod 2 protruding out of the second end cover plate 6. A bellow 10 is further disposed inside the insulating housing 7, the second conductive rod 2 is slidably disposed in the bellow 10, and two ends of the bellow 10 contact the vacuum tube body 8 and the insulating housing 7 respectively.

FIG. 2 is a schematic cross-sectional structural view of two contacts of the vacuum switch tube according to the first embodiment of the present invention. As shown in FIG. 2, a portion of a front end of the first contact 3 that contacts a contact body 40 of the second contact 4 is a convex hemisphere 30. A rear end of the first contact 3 is a hemisphere with the same shape as the convex hemisphere 30. That is, the first contact 3 is a sphere as a whole. The contact body 40 of the second contact 4 may adopt an annular body. The contact body 40 of the second contact 4 has a circular cross section along an axial direction, and the annular body has an annular cross section in a direction perpendicular to the axial direction, such that the contact body 40 of the second contact 4 and the convex hemisphere 30 at the front end of the first contact 3 are coupled and matched with each other.

In addition, the vertical cross section of the contact body 40 of the second contact 4 along the axial direction may also be triangular, square, or rectangular. In practical applications, the shape of the vertical cross section of the contact body 40 of the second contact 4 along the axial direction may have various forms and are not limited to the above circular, elliptic, or triangular shape, as long as the shape matches with that of the front end of the first contact, and the annular body and the front end of the first contact are able to couple and match with each other.

In this embodiment, the rear end of the first contact 3 may also be a cylinder, and a cross section of the cylinder is a circular with the same area as that of the cross section of the hemisphere. The rear end of the first contact 3 in this embodiment may also be any other shape, as long as the front end of the first contact 3 maintains a convex hemisphere and the cross section where the rear end and the front end are connected is circular.

The vertical cross section of the contact body 40 of the second contact 4 along the axial direction may be circular, elliptic, triangular, or may also be square or rectangular. In practical applications, the shapes of the vertical cross section of the contact body 40 along the axial direction may also be various forms and are not limited to the above circular, elliptic, or triangular, as long as the shape of the cross section of the annular body in a direction being perpendicular to the axial direction matches with that of the front end of the first contact 3 and the annular body and the front end of the first contact 3 are enabled to be coupled and matched with each other.

Figure 3:
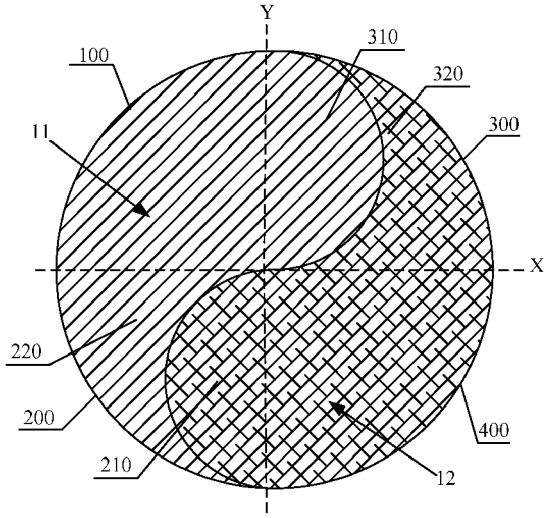
FIG. 3 is a schematic structural view of a cross section of a first contact of the vacuum switch tube according to the first embodiment of the present invention.

FIG. 3 is a schematic structural view of a cross section of a first contact of the vacuum switch tube according to the first embodiment of the present invention. As shown in FIG. 3, the convex hemisphere 30 of the first contact 3 includes a first conductive member 11 and a first magnetic member 12. The first conductive member 11 and the first magnetic member 12 extend in the same direction and match with each other, which are yin-yang-fish matched. The cross section of the convex hemisphere 30 is circular, and any one cross section is equally divided into an upper left region 100, a lower left region 200, an upper right region 300, and a lower right region 400 by its own vertical midline Y and horizontal midline X. The upper right region 300 is divided into a first upper right region 310 neighboring the upper left region 100 and a second upper right region 320 formed by an area other than the first upper right region 310. The lower left region 200 is divided into a first lower left region 210 neighboring the lower right region 400 and a second lower left region 220 formed by an area other than the first lower left region 210. The conductive material such as copper is disposed at the first upper right region 310, the upper left region 100, and the second lower left region 220 to form the first conductive member 11. The magnetic material such as iron is disposed at the first lower left region 210, the lower right region 400, and the second upper right region 320 to form the first magnetic member 12.

The first upper right region 310 and the first lower left region 210 are half circles with diameters equal to a radius of the cross section. A diameter edge of the first upper right region 310 is adjacent to the upper left region 100. A diameter edge of the first lower left region 210 is adjacent to the lower right region 400. Thus, the first conductive member 11 and the first magnetic member 12 form a yin-yang-fish shape by joining and matching with each other.

When being viewed from the top, the contact body 40 of the second contact 4 has an annular structure. The contact body 40 of the second contact 4 is partitioned into a second conductive member and a second magnetic member by its own midline. When the two contacts are disposed, the first magnetic member 12 of the first contact 3 and the second magnetic member of the contact body 40 of the second contact 4 are anti-symmetrically disposed. That is, the first magnetic member 12 of the first contact 3 and the second conductive member of the second contact 4 are correspondingly disposed, and the first conductive member 11 of the first contact 3 and the second magnetic member of the second contact 4 are correspondingly disposed.

In the operating process of the vacuum switch tube, the first magnetic member 12 generates lines of magnetic force when the first conductive member 11 is powered on, and a distribution trend of the lines of magnetic force is flowing from a larger area end to a smaller area end of the yin-yang-fish. When the contacts are applied, the first contact 3 and the second contact 4 are anti-symmetrically disposed. The first conductive member 11 of the first contact 3 and the second magnetic member of the second contact 4 are disposed facing each other, and the first magnetic member 12 of the first contact 3 and the second conductive member of the second contact 4 are disposed facing each other. When a distance between the two vacuum switch contacts is smaller than half of a perimeter of the cross section of the first contact 3, the lines of magnetic force flowing from the larger area end to the smaller area end of the yin-yang-fish in the first contact 3 is changed to flow into the second magnetic member of the second contact 4.

This solution is based on the principle that the lines of magnetic force always select the shortest path in distribution. Since two vacuum switch contacts are anti-symmetrically disposed in the vacuum switch tube, the lines of magnetic force between the contact surfaces generate a rotating closed magnetic field loop, such that the vacuum switch tube has better current breaking capability and better high voltage resistant capability. For the above technical solution, in one aspect, the structure of the first magnetic member is designed to enable the lines of magnetic force to change from surrounding the circumference of one contact to flow into the other contact, so as to form a vertical magnetic field between the two contacts. In another aspect, the two contacts are configured into a sphere and an annular body matching and coupling with each other. Thus, a magnetic field distribution in the prior art with uniform lines of magnetic force formed between two parallel planes is changed into a magnetic field distribution with radial lines of magnetic force formed between two spatial surfaces. The rotation of lines of magnetic force is easily formed between the contact surfaces while effectively reducing a magnetic field intensity, and a rotating closed magnetic field loop is generated, so as to increase the high voltage resistant capability of the contact surfaces and enhance the current breaking capability of the vacuum switch contact, such that the vacuum switch tube is applicable to higher voltage circuitry, thereby satisfying the high voltage resistant requirements for a vacuum switch tube in an electric power equipment. The technical solution in this embodiment can realize the capability of breaking voltages of higher than 40.5 kilovolts such as 55 kilovolts, 72.5 kilovolts, and 110 kilovolts.

Particularly, the shape of the first conductive member 11 and the first magnetic member 12 in the contact body of the first contact 3 is not limited to be yin-yang-fish matched. When the cross section of the contact body of the first contact 3 is divided by using the above way, the shape of the half circle regions also be replaced by circle-crown, trapezoid or triangular, polygon, trapezoid-like or other shapes.

Second Embodiment of Vacuum Switch Tube

Figure 4:
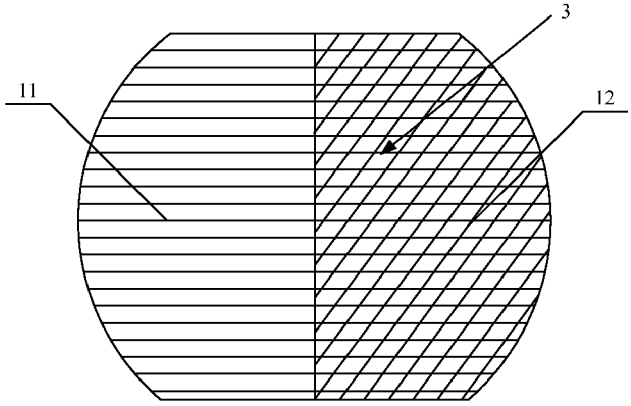
FIG. 4 is a schematic structural view of an external profile of a first contact of a vacuum switch tube according to a second embodiment of the present invention.

FIG. 4 is a schematic structural view of an external profile of a first contact of a vacuum switch tube according to a second embodiment of the present invention. As shown in FIG. 4, the convex hemisphere 30 of the first contact 3 may be formed by a plurality of sheets laminated with each other. A shape of a cross section of each sheet and a structural relation between the first conductive member 11 and the first magnetic member 12 adopt the structure of the above first contact 3. The technical solution of this embodiment can simplify the manufacturing process of the contacts. After a plurality of sheets is prepared through a simple molding process, the sheets may be put in a metal shell corresponding to a profile of the shape of the first conductive member 11 and/or a profile of the shape of the first magnetic member 12, or in a metal shell corresponding to an external profile of the first contact 3, and then the sheet metal is melted over heating, so as to form the first conductive member 11 and the first magnetic member 12 respectively, thereby forming an integral first contact 3.

The technical solution in this embodiment further simplifies the manufacturing process of the contacts on the basis of achieving technical effects of the vacuum switch tube according to the first embodiment of the present invention.

Third Embodiment of Vacuum Switch Tube

Figure 5:
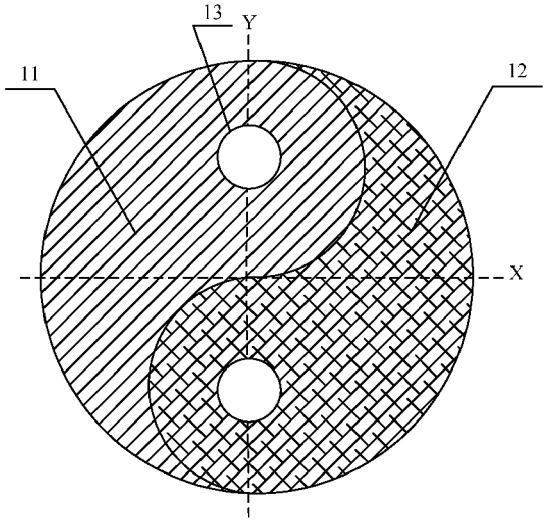
FIG. 5 is a schematic structural view of a cross section of a first contact with securing rods in a vacuum switch tube according to a third embodiment of the present invention.

In order to secure the relative positions of the first conductive member 11 and the first magnetic member 12 before the sheets are melted and solidified, securing rods 13 may be further inserted through securing holes into the first conductive member 11 and the first magnetic member 12. An end of each securing rod 13 is secured at a bottom portion inside the metal shell. FIG. 5 is a schematic structural view of a cross section of a first contact with securing rods in a vacuum switch tube according to a third embodiment of the present invention. As shown in FIG. 5, the securing rods 13 penetrate each sheet. The securing rods 13 may be made of the same material as the first conductive member 11, for example, copper. The securing rods are disposed to facilitate the assembling and securing operations of conductive sheets and magnetic sheets of the vacuum switch tube according to the second embodiment of the present invention.

The contact body of the first contact is not limited to consist of sheets, and the contact body also may be consist of a plurality of conductive and magnetic poles or particles adjacent each other closely.

Finally, it should be noted that the above embodiments are merely provided for describing the technical solutions of the present invention, but not intended to limit the present invention. It should be understood by persons of ordinary skill in the art that, although the present invention has been described in detail with reference to the preferred embodiments, modifications or equivalent replacements can still be made to the technical solutions of the present invention, as long as such modifications or equivalent replacements do not cause the modified technical solutions to depart from the spirit and scope of the present invention.

What is claimed is:

1. A vacuum switch tube, comprising: a first conductive rod and a second conductive rod, wherein a first contact is disposed at an end of the first conductive rod, a second contact is disposed at an end of the second conductive rod, and the first contact and the second contact are sealed in a vacuum tube body and disposed facing each other; a front end of the first contact is a convex hemisphere, the second contact is an annular body matching with a shape of the convex hemisphere, and the first contact comprises a first conductive member and a first magnetic member, the first conductive member and the first magnetic member extend in the same direction and match with each other in adjacent, the cross section shape of the first magnetic members is divided by a neutrality line into two unequal regions; the second contact comprises a second conductive member and a second magnetic member, and the second conductive member and the second magnetic member are partitioned by a midline of the second contact; the first magnetic member of the first contact and the second conductive member of the second contact are correspondingly disposed, and the second magnetic member of the second contact and the first conductive member of the first contact are correspondingly disposed.

2. The vacuum switch tube according to claim 1, wherein a cross section of the contact body of the first contact is equally divided into an upper left region, a lower left region, an upper right region, and a lower right region by a vertical midline and a horizontal midline thereof; the upper right region is divided into a first upper right region neighboring the upper left region and a second upper right region other than the first upper right region; the lower left region is divided into a first lower left region neighboring the lower right region and a second lower left region other than the first lower left region; the conductive member is disposed in the first upper right region, the upper left region and the second lower left region, and the magnetic member is disposed in the first lower left region, the lower right region and the second upper right region.

3. The vacuum switch tube according to claim 2, wherein the first upper right region and/or the first lower left region are half circle, a diameter edge of the first upper right region is adjacent to the upper left region, and a diameter edge of the first lower left region is adjacent to the lower right region.

4. The vacuum switch tube according to claim 1, wherein the contact body of the first contact is disposed in a cylindrical metal shell.

5. The vacuum switch tube according to claim 4, wherein the contact body consists of a plurality of conductive and magnetic poles or particles adjacent each other closely.

6. The vacuum switch tube according to claim 1, wherein the first contact comprises a plurality of sheets laminated with each other, each of the sheets is formed by a conductive sheet and a magnetic sheet joining and combining with each other, a plurality of conductive sheets form the first conductive member, a plurality of magnetic sheets form the first magnetic member, and the first contact is disposed in a metal shell with a matching shape.

7. The vacuum switch tube according to claim 6, wherein securing holes penetrating each of the sheets are opened in the conductive sheets and the magnetic sheets, securing rods are inserted in the securing holes, and one end of each of the securing rods is secured at a bottom portion inside the metal shell.

* * * * *